US008445418B2

(12) United States Patent
Yamada

(10) Patent No.: US 8,445,418 B2
(45) Date of Patent: May 21, 2013

(54) LUBRICATING OIL COMPOSITION FOR INTERNAL COMBUSTION ENGINE

(75) Inventor: Ryo Yamada, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 106 days.

(21) Appl. No.: 13/063,765

(22) PCT Filed: Sep. 17, 2009

(86) PCT No.: PCT/JP2009/066242

§ 371 (c)(1),
(2), (4) Date: Mar. 14, 2011

(87) PCT Pub. No.: WO2010/032781

PCT Pub. Date: Mar. 25, 2010

(65) Prior Publication Data

US 2011/0166053 A1 Jul. 7, 2011

(30) Foreign Application Priority Data

Sep. 19, 2008 (JP) ..... 2008-241400

(51) Int. Cl.
*C10M 135/18* (2006.01)
*C10M 145/14* (2006.01)
*C10M 169/00* (2006.01)

(52) U.S. Cl.
USPC ..... 508/363; 508/469; 508/534

(58) Field of Classification Search
USPC ..... 508/363, 469, 534
See application file for complete search history.

(56) References Cited

U.S. PATENT DOCUMENTS

| | | | | |
|---|---|---|---|---|
| 2002/0002120 | A1* | 1/2002 | Gahagan | 508/396 |
| 2004/0132629 | A1* | 7/2004 | Vinci et al. | 508/470 |
| 2005/0082139 | A1* | 4/2005 | Ishikawa et al. | 192/107 M |
| 2007/0191239 | A1 | 8/2007 | Matsuoka et al. | |
| 2008/0096775 | A1 | 4/2008 | Kasai | |
| 2009/0075852 | A1 | 3/2009 | Yagishita et al. | |
| 2009/0131291 | A1 | 5/2009 | Kurosawa et al. | |
| 2010/0035777 | A1 | 2/2010 | Sano et al. | |

FOREIGN PATENT DOCUMENTS

| | | | |
|---|---|---|---|
| CN | 101120077 | A | 2/2008 |
| EP | 1 780 257 | A1 | 5/2007 |
| EP | 1 808 476 | A1 | 7/2007 |
| EP | 1 845 151 | A1 | 10/2007 |
| EP | 2 009 083 | A1 | 12/2008 |
| JP | 8 302378 | | 11/1996 |
| JP | 2005 154760 | | 6/2005 |
| JP | 2008 88215 | | 4/2008 |
| WO | 2007 119299 | | 10/2007 |
| WO | 2008 093446 | | 8/2008 |

OTHER PUBLICATIONS

Extended European Search Report issued Feb. 17, 2012 in patent application No. 09814625.1.
International Search Report Issued Dec. 15, 2009 in PCT/JP09/066242 filed Sep. 17, 2009.
Combined Office Action and Search Report issued Nov. 5, 2012 in Chinese Application No. 200980136728.4 (With English Translation).

* cited by examiner

*Primary Examiner* — Prem C Singh
*Assistant Examiner* — Francis C Campanell
(74) *Attorney, Agent, or Firm* — Oblon, Spivak, McClelland, Maier & Neustadt, L.L.P.

(57) ABSTRACT

A lubricating oil composition for an internal combustion engine contains: a base oil having a viscosity index of 120 or more; and a polymer compound that includes a first constituent having a mass average molecular weight of less than 100,000 and a second constituent having a mass average molecular weight of 100,000 or more, the first constituent of 0.01 mass % to 10 mass % being contained relative to a total amount of the lubricating oil composition, preferably 0.1 mass % to 10 mass %, the second constituent of less than 0.5 mass % being contained relative to the total amount of the lubricating oil composition. A viscosity index of the lubricating oil composition is 130 or more.

10 Claims, No Drawings

LUBRICATING OIL COMPOSITION FOR INTERNAL COMBUSTION ENGINE

TECHNICAL FIELD

The present invention relates to a lubricating oil composition for an internal combustion engine.

BACKGROUND ART

Energy-saving has currently been required in various fields. Also in an internal combustion engine of an automobile and the like, energy-saving, i.e., low fuel consumption has been strongly desired.

A lubricating oil, which is used for lubrication of sliding parts in the internal combustion engine, generally exhibits decreasing viscosity in accordance with increasing temperature. However, viscosity retention of the lubricating oil at a high temperature is also significant in order to maintain lubricity and wear resistance of bearings. For instance, an engine oil of SAE (Society of Automotive Engineers) viscosity grade 30 is required to maintain 2.9 mPa·s or more of a high-shear viscosity at 150 degrees C.

Moreover, a viscosity around 80 degrees C. is also reported to affect fuel consumption, where low fuel consumption is more achievable as the viscosity around 80 degrees C. decreases. Accordingly, the lubricating oil having a high viscosity index is favorable. In most lubricating oils, various additives are mixed with a base oil. A polymer compound called a viscosity index improver is often added thereto in order to increase the viscosity index (see, for instance, Patent Literature 1).

CITATION LISTS

Patent Literatures

Patent Literature 1 JP-A-8-302378

SUMMARY OF THE INVENTION

Problems to be Solved by the Invention

The polymer compound used as the viscosity index improver is more capable of improving the viscosity index of the lubricating oil as a molecular weight of the polymer compound increases. However, it is known that orientation of molecular chains of polymers used as the viscosity index improver causes a temporary decrease in viscosity in parts where high shear force is given (e.g., a bearing of an engine).

Accordingly, a typical lubricating oil for an internal combustion engine has necessarily been designed to exhibit a high viscosity at low shear in order to maintain a high-temperature high-shear viscosity, which impairs saving-fuel performance.

An object of the invention is to provide a lubricating oil composition for an internal combustion engine exhibiting a high viscosity index, a low rate of decrease in viscosity at high-temperature high-shear and a low viscosity at low shear.

Means for Solving the Problems

Specifically, the invention provides a lubricating oil composition for an internal combustion engine as follows:

(1) A lubricating oil composition for an internal combustion engine containing: a base oil having a viscosity index of 120 or more; and a polymer compound that includes a first constituent having a mass average molecular weight of less than 100,000 and a second constituent having a mass average molecular weight of 100,000 or more, the first constituent of 0.01 mass % to 10 mass % being contained relative to a total amount of the lubricating oil composition, preferably 0.1 mass % to 10 mass %, the second constituent of less than 0.5 mass % being contained relative to the total amount of the lubricating oil composition, in which a viscosity index of the lubricating oil composition is 130 or more.

(2) The lubricating oil composition for the internal combustion engine described in (1), in which the polymer compound is at least one component selected from polymethacrylate, olefin copolymers, styrene copolymers and polyisobutylene.

(3) The lubricating oil composition for the internal combustion engine described in (1) or (2), in which the base oil is at least one of a mineral oil and a synthetic oil.

(4) The lubricating oil composition for the internal combustion engine described in any one of (1) to (3), further including at least one of a molybdenum-based friction modifier and an ashless friction modifier.

According to the invention, the lubricating oil composition for the internal combustion engine exhibiting a high viscosity index, a low rate of decrease in viscosity at high-temperature high-shear and a low viscosity at low shear can be provided.

DESCRIPTION OF EXEMPLARY EMBODIMENTS

A lubricating oil composition for an internal combustion engine according to an aspect of the invention (hereinafter, occasionally referred to as "the composition") contains: a base oil having a viscosity index of 120 or more; and a polymer compound that includes a first constituent having a mass average molecular weight of less than 100,000 and a second constituent having a mass average molecular weight of 100,000 or more, the first constituent of 0.01 mass % to 10 mass % being contained relative to a total amount of the lubricating oil composition, preferably 0.1 mass %, the second constituent of less than 0.5 mass % being contained relative to the total amount of the lubricating oil composition. A viscosity index of the composition is 130 or more. The composition of the aspect of the invention will be described in detail below.

[Base Oil]

A base oil used in the aspect of the invention is a lubricating base oil formed of a mineral oil, a synthetic oil or a mixture thereof and exhibits a viscosity index of 120 or more. A low-shear viscosity of the lubricating composition for the internal combustion engine can be lowered in accordance with increase in the viscosity index of the base oil. The viscosity index of the lubricating composition is preferably 130 or more.

Examples of the mineral oil include: a mineral oil refined by processing a lubricating oil fraction by at least one of solvent-deasphalting, solvent-extracting, solvent-dewaxing, catalytic-dewaxing, hydrorefining and hydrocracking (the lubricating oil fractions is obtained by vacuum-distilling atmospheric residual oil obtained by atmospherically distilling crude oil); or a mineral oil that is manufactured by isomerizing mineral oil-based wax and wax manufactured by Fischer Torpsh process (GTL wax).

Particularly, the base oil having the viscosity index of 120 or more according to the aspect of the invention can preferably be produced by solvent-dewaxing or hydrodewaxing a produced oil that is obtained by hydroisomerizing wax or hydrocracking heavy oil.

For instance, in hydroisomerization of wax, wax having a boiling point in a range of 300 to 600 degrees C. and having 20 to 70 carbon atoms (e.g., slack wax obtained during solvent dewaxing of mineral oil-based lubricating oil and wax obtained by Fischer Torpsh synthesis) is brought into contact with a hydroisomerization catalyst (e.g., a catalyst formed by supporting at least one of Group 8 metals such as nickel and cobalt and Group 6A metals such as molybdenum and tungsten on alumina or silica-alumina, a zeolite catalyst or a catalyst formed by supporting platinum and the like on a zeolite-containing support) under presence of hydrogen having hydrogen partial pressure of 5 to 14 MPa at a temperature of 300 to 450 degrees C. at LHSV (liquid-space velocity) of 0.1 to 2 hours-l. Preferably, a conversion rate of linear-chain paraffin is 80% or more and a conversion rate to a light fraction is 40% or less.

Alternatively, in hydrocracking, atmospheric distillate oil having a boiling point in a range of 300 to 600 degrees C., vacuum distillate oil or bright stock that is hydrodesulfurized or denitrogenated as needed is brought into contact with a hydroisomerization catalyst (e.g., a catalyst formed by supporting on silica-alumina at least one of Group 8 metals such as nickel and cobalt and at least one of Group 6A metals such as molybdenum and tungsten) under presence of hydrogen having hydrogen partial pressure of 7 to 14 MPa at a temperature of 350 to 450 degrees C. at LHSV (liquid-space velocity) of 0.1 to 2 hours-l. Preferably, a cracking rate (100−volume % of a fraction having a temperature of 360 degrees C. or more in the hydrocracked product) is made in a range of 40 to 90%.

A light fraction is distilled from the hydroisomerized oil or hydrocracked oil obtained by the above process, thereby providing a lubricating oil fraction. However, direct use of the lubricating oil fraction generally exhibits a high pour point. Accordingly, when a dewaxing treatment is conducted on the lubricating oil fraction to remove wax therefrom, thereby providing a lubricating base oil having 80 or more % CP in n-d-M ring analysis and a pour point of −10 degrees C. or less.

When the solvent dewaxing treatment is applied for wax removal, prior to the solvent dewaxing treatment, the light fraction is distilled to be separated using a precision distillation instrument so that 70 volume % or more of a fraction in a range of a boiling point of 371 to less than 491 degrees C. by gas chromatography distillation method remains therein, which is favorable for conducting the solvent dewaxing treatment more efficiently. The solvent dewaxing treatment is favorably conducted by using, for instance, methyl ethyl ketone/toluene (a volume ratio of 1 to 1) in a range of 2/1 to 4/1 of a ratio of solvent to oil at a temperature of −15 to −40 degrees C.

On the other hand, when wax is removed by hydrodewaxing, the light fraction may be distilled to the extent not hampering the hydrodewaxing. The lubricating oil fraction after hydrodewaxing is separated by distillation using a precision distillation instrument so that 70 volume % or more of a fraction in a range of a boiling point of 371 to less than 491 degrees C. by gas chromatography distillation method remains therein, which is favorable for conducting the hydrodewaxing efficiently. In the above hydrodewaxing, the lubricating oil fraction is brought into contact with a zeolite catalyst under presence of hydrogen having a hydrogen partial pressure of 3 to 15 MPa at a temperature of 320 to 430 degrees C. at LHSV (liquid-space velocity) of 0.2 to 4 hours-l. The final lubricating base oil preferably exhibits a pour point of −10 degrees C. or less.

The lubricating oil fraction obtained by the above methods can further be processed by solvent refining or hydrorefining as desired.

A variety of typically known synthetic oils are usable. Examples of the synthetic oils are poly-α-olefin (including α-olefin copolymer), polybutene, polyol ester, diacid ester, aromatic ester, phosphate ester, polyphenyl ether, alkylbenzene, alkylnaphthalene, polyoxyalkylene glycol, neopentyl glycol, silicone oil, trimethylolpropane, pentaerythritol and hindered ester. Particularly, poly-α-olefin is preferable in view of a relatively high viscosity index and a composition similar to a mineral oil to allow an application of an additive used for typical mineral oils.

The base oil used in the aspect of the invention may be a mixture of two types of mineral oils or two types of synthetic oils, or a mixture of a mineral oil and a synthetic oil, as long as the above properties are satisfied. A mixing ratio of two or more types in the base oil in the mixture can be selected as desired.

The base oil used in the aspect of the invention preferably has kinematic viscosity at 100 degrees C. in a range of 2 to 20 $mm^2/s$, more preferably in a range of 3 to 15 $mm^2/s$, further more preferably in a range of 3.5 to 10 $mm^2/s$. When the kinematic viscosity of the base oil is too high, stirring resistance of an obtained lubricating oil composition is increased and friction coefficient in fluid-lubricated area is increased, thereby deteriorating saving-fuel performance. In contrast, when the kinematic viscosity is too low, wear is increased at a sliding part such as a valve system, piston, ring or bearing in the internal combustion engine.

[Polymer Compound]

The lubricating oil composition for the internal combustion engine according to the aspect of the invention can be provided by blending the above-described base oil with a polymer compound including a first constituent having a mass average molecular weight of less than 100,000 and a second constituent having a mass average molecular weight of 100,000 or more, the first constituent of 0.01 mass % to 10 mass % being contained relative to a total amount of the lubricating oil composition, preferably 0.1 mass % to 10 mass %, the second constituent of less than 0.5 mass % being contained relative to the total amount of the lubricating oil composition.

The mass average molecular weight of the polymer compound mixed to the base oil is arranged to be less than 100,000. This is because, although the viscosity index is more improved in accordance with increase in the molecular weight of the polymer compound mixed to the base oil, orientation of molecular chains of the polymer compounds caused by shear may result in a temporary decrease in viscosity, whereby high-temperature high-shear viscosity in need may not be maintained. Alternatively, molecular chains of the polymer compound may be cut in use to decrease the molecular weight, whereby the viscosity may be decreased.

Accordingly, it is desirable that the polymer compound having the mass average molecular weight of 100,000 or more is not contained. However, in some cases, such a polymer compound may be added in order to improve the viscosity index. Even in such cases, when the amount of the polymer compound is provided at less than 0.5 mass %, the lubricating oil composition for the internal combustion engine according to the aspect of the invention is obtainable.

The mass average molecular weight of the polymer compound is preferably 70,000 or less, more preferably 50,000 or less.

The polymer compound is preferably exemplified by at least one selected from the group consisting of polymethacrylates (PMA), olefin copolymers, styrene copolymers (e.g., styrene-diene hydrogenated copolymers) and polyisobutylene. Both of dispersed and non-dispersed polymethacrylates are usable. A representative olefin copolymer is ethylene-α-olefin copolymer. Ethylene-α-olefin copolymer is a copolymer of ethylene having an ethylene unit of 15 to 80 mol % and α-olefin having 3 to 20 carbon atoms such as propylene, 1-butene or 1-decene, which may be a random copolymer or a block copolymer. The copolymer is non-dispersed relative to the lubricating oil. However, a dispersed copolymer that is obtained by grafting ethylene-α-olefin copolymer with maleic acid, N-vinylpyrrolidone, N-vinylimidazole, glycidyl acrylate and the like is usable. One of the polymer compounds may be used alone, or two or more of the polymer compounds may be used in combination. Polymethacrylates (PMA) and olefin copolymers are more preferable.

[Friction Modifier]

In the lubricating oil composition for the internal combustion engine according to the aspect of the invention, a molybdenum-based friction modifier or an ashless friction modifier is preferably mixed in order to improve saving-fuel performance. Combination of the molybdenum-based friction modifier and the ashless friction modifier is further preferable in use.

The molybdenum-based friction modifier to be used is preferably at least one selected of molybdenum dithiocarbamate (MoDTC), molybdenum dithiophosphate (hereinafter, occasionally referred to as MoDTP) and an amine salt of molybdenum acid (hereinafter, occasionally referred to as Mo amine salt). Among the molybdenum-based friction modifiers, MoDTC is preferable in view of effectiveness. One of the molybdenum-based friction modifiers may be used alone, or two or more thereof may be used in combination. An amount of molybdenum based on the total amount of the composition is preferably in a range of 10 to 1000 mass ppm, more preferably of 100 to 800 mass ppm. When the amount of molybdenum is less than 10 mass ppm, low friction is not sufficiently obtained. When the amount of molybdenum is over 1000 mass ppm, improvement in friction property is not in proportion to the amount thereof.

MoDTC is represented by a formula (I) below.

[Chemical Formula 1]

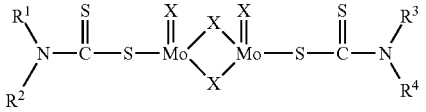

(I)

In the formula (I), $R^1$ to $R^4$ each represent a hydrocarbon group having 5 to 16 carbon atoms, all of which may be the same or different. X represents S (sulfur atom) or O (oxygen atom). Examples of the hydrocarbon group represented by $R^1$ to $R^4$ are an alkyl group having 5 to 16 carbon atoms, an alkenyl group having 5 to 16 carbon atoms, a cycloalkyl group having 5 to 16 carbon atoms, an alkylaryl group having 5 to 16 carbon atoms and an arylalkyl group having 5 to 16 carbon atoms. Specifically, examples of the hydrocarbon having 5 to 16 carbon atoms are pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, ocytenyl groups, nonenyl groups, decenyl groups, undecenyl groups, dodecenyl groups, tridecenyl groups, tetradecenyl group, pentadecenyl groups, a cyclohexyl group, a dimethylcyclohexyl group, an ethylcyclohexyl group, a methylcyclohexylmethyl group, a cyclohexylethyl group, a propylcyclohexyl group, a butylcyclohexyl group, a heptylcyclohexyl group, a phenyl group, a tolyl group, a dimethylphenyl group, a butylphenyl group, a nonylphenyl group, a methylbenzyl group, a phenylethyl group, a naphthyl group and a dimethyl naphthyl group.

MoDTP is represented by a formula (II) below.

[Chemical Formula 2]

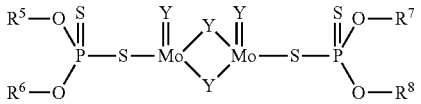

(II)

In the formula (II), $R^5$ to $R^8$ each represent a hydrocarbon group having 5 to 16 carbon atoms, all of which may be the same or different. Y represents S (sulfur atom) or O (oxygen atom). Examples of the hydrocarbon group represented by $R^5$ to $R^8$ are an alkyl group having 5 to 16 carbon atoms, an alkenyl group having 5 to 16 carbon atoms, a cycloalkyl group having 5 to 16 carbon atoms, an alkylaryl group having 5 to 16 carbon atoms and an arylalkyl group having 5 to 16 carbon atoms. Specifically, examples of the hydrocarbon having 5 to 16 carbon atoms are pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, ocytenyl groups, nonenyl groups, decenyl groups, undecenyl groups, dodecenyl groups, tridecenyl groups, tetradecenyl group, pentadecenyl groups, a cyclohexyl group, a dimethylcyclohexyl group, an ethylcyclohexyl group, a methylcyclohexylmethyl group, a cyclohexylethyl group, a propylcyclohexyl group, a butylcyclohexyl group, a heptylcyclohexyl group, a phenyl group, a tolyl group, a dimethylphenyl group, a butylphenyl group, a nonylphenyl group, a methylbenzyl group, a phenylethyl group, a naphthyl group and a dimethyl naphthyl group.

A Mo amine salt is a secondary amine salt of molybdenum acid, which is represented by a formula (III) below.

[Chemical Formula 3]

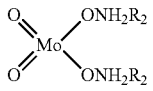

(III)

In the formula (III), R represents a hydrocarbon group having 5 to 18 carbon atoms, four of which may be the same or different. Examples of the hydrocarbon group having 5 to 18 carbon atoms are an alkyl group having 5 to 18 carbon atoms, an alkenyl group having 5 to 18 carbon atoms, a cycloalkyl group having 5 to 18 carbon atoms, an alkylaryl group having 5 to 18 carbon atoms and an arylalkyl group having 5 to 18 carbon atoms. Specifically, examples of the hydrocarbon having 5 to 18 carbon atoms are pentyl groups, hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, ocytenyl groups, nonenyl groups, decenyl groups, undecenyl groups, dodecenyl groups, tridecenyl groups, tetradecenyl group, pentadecenyl groups, a cyclohexyl group, a dimethylcyclohexyl group, an ethylcyclohexyl group, a methylcyclohexylmethyl group, a cyclohexylethyl group, a propylcyclohexyl group, a butylcyclohexyl group, a heptylcyclohexyl group, a phenyl group, a tolyl group, a dimethylphenyl group, a butylphenyl group, a nonylphenyl group, a methylbenzyl group, a phenylethyl group, a naphthyl group and a dimethyl naphthyl group.

Examples of the ashless friction modifier are a fatty acid, higher alcohol, fatty acid ester, oils and fats, amine, amide and ester sulfide. One of the friction modifiers may be used alone, or a plurality thereof may be used in combination. An amount thereof is typically in a range of 0.01 to 10 mass % based on the total amount of the composition.

[Lubricating Oil Composition for Internal Combustion Engine]

The lubricating oil composition for internal combustion engine according to the aspect of the invention may be obtained by: arranging the viscosity index of the base oil, the mass average molecular weight of the polymer compound and the amount of the polymer compound in the above defined range; and mixing the base oil and the polymer compound so that the composition exhibits the viscosity index of 130 or more. As long as the mixture exhibits such properties, any one or more of the base oils and any one or more of the polymer compounds described above can be combined in use.

In the composition according to the aspect of the invention, a rate of decrease in viscosity at high shear at 150 degrees C. relative to a low shear viscosity is preferably 3.0% or less. In the lubricating oil for internal combustion engine having more than 3.0% of the rate of decrease in viscosity at high shear, viscosity at low shear is required to be set high in expectation of decrease in viscosity. Otherwise, saving-fuel performance may be deteriorated.

Further, the kinematic viscosity at 100 degrees C. of the lubricating oil composition is preferably less than 9.0 $mm^2/s$. When the kinematic viscosity is 9.0 $mm^2/s$ or more, which is too high for the kinematic viscosity of practical temperature range (80 degrees C. to 100 degree C.) of the lubricating oil for the internal combustion engine, saving-fuel performance cannot be achieved.

In particular, when the lubricating oil composition exhibits 2.9 mPa·s or more of high-shear viscosity at 150 degrees C. (equivalent to SAE viscosity grade 30), the kinematic viscosity at 100 degrees C. is desirably less than 9.0 $mm^2/s$. When the lubricating oil composition exhibits 2.6 mPa·s or more of high-shear viscosity at 150 degrees C. (equivalent to SAE viscosity grade 20), the kinematic viscosity at 100 degrees C. is desirably less than 7.8 $mm^2/s$. When the kinematic viscosity at 100 degrees C. exceeds the above, the viscosity of the lubricating oil for the internal combustion engine in the practical temperature range (80 degrees C. to 100 degree C.) becomes too high, whereby saving-fuel performance may be inferior to conventional oil.

[Other Additives]

Moreover, in the lubricating oil composition for the internal combustion engine according to the aspect of the invention, as long as an object of the invention is not hampered, various additives represented by ashless dispersant, metal detergent, extreme pressure agent, metal deactivator, rust inhibitor, antifoaming agent, anti-emulsifier and coloring agent may be singularly used, or a combination of two or more additives thereof may be used.

Examples of the ashless dispersant include: polybutenyl succinimide, polybutenyl benzylamines and polybutenyl amine having a polybutenyl group of a number average molecular weight of 900 to 3,500; and derivatives thereof (e.g., a borated derivative thereof). These ashless dispersants may be singularly used, or a plurality thereof may be used in combination. A content thereof is typically in a range of 0.01 to 10 mass % based on a total amount of the composition.

Examples of the metal detergent include sulfonate, phenate, salicylate and naphthenate of alkali metal (e.g., sodium (Na) and potassium (K)) or alkali earth metal (e.g., calcium (Ca) and magnesium (Mg)). These metal detergents may be singularly used, or a plurality thereof may be used in combination. A total base number and a content of the metal detergents may be selected depending on required properties of the lubricating oil. The total base number is typically in a range of 0 to 500 mg KOH/g in perchloric acid method, desirably in a range of 10 to 400 mg KOH/g. The content of the metal detergents is typically in a range of 0.1 to 10 mass % based on the total amount of the composition.

Examples of the extreme pressure agent include: a sulfur compound such as olefin sulfide, dialkyl polysulfide, diarylalkyl polysulfide and diaryl polysulfide; a phosphorous compound such as phosphate ester, thiophosphate ester, phosphite ester, alkyl hydrogen phosphite, phosphate ester amine salt and phosphite ester amine salt. A content of the extreme pressure agent is typically in a range of 0.01 to 10 mass % based on the total amount of the composition.

Examples of the metal deactivator include: benzotriazole; a derivative of triazoles; a derivative of benzotriazole and a derivative of thiadiazole. A content of the metal deactivator is typically in a range of 0.01 to 3 mass % based on the total amount of the composition.

Examples of the rust inhibitor include: fatty acid; alkenylsuccinic acid half ester; fatty acid soap; alkyl sulfonate; sulfonate, phenate, salicylate and naphthenate of alkali earth metal (e.g., calcium (Ca), magnesium (Mg) and barium (Ba)); fatty acid ester of polyhydric alcohol, fatty acid amine, oxidized paraffin and alkylpolyoxyethylene ether. A content of the rust inhibitor is typically in a range of 0.01 to 5 mass % based on the total amount of the composition.

A liquid silicone, suitable as the antifoaming agent, is exemplified by methylsilicone, fluorosilicone and polyacrylate. A content of the antifoaming agent is preferably in a range of 0.0005 to 0.1 mass % based on the total amount of the composition.

Examples of the anti-emulsifier include: ethylene-propylene block polymer; and sulfonate, phenate, salicylate and naphthenate of alkali earth metal (e.g., calcium (Ca) and magnesium (Mg)). A content of the anti-emulsifier is typically in a range of 0.0005 to 1 mass %.

Examples of the coloring agent include a dye and a pigment. A content of the coloring agent is preferably in a range of 0.001 to 1 mass % based on the total amount of the composition.

Thus prepared lubricating oil composition for the internal combustion engine according to the aspect of the invention is in a combination as described above, thereby providing such advantages as a high viscosity index, a low rate of decrease in viscosity at high-temperature high-shear and a low viscosity at low shear. Accordingly, the lubricating oil composition according to the aspect of the invention is suitably used for the internal combustion engine.

EXAMPLES

Next, the invention will be described in more detail by reference to Examples, which by no means limit the invention.

Properties of a lubricating oil composition (sample oil) in each Example were measured by the following method.

(1) Kinematic Viscosity (40 Degrees C., 80 Degrees C., 100 Degrees C.) and Viscosity Index:

Measured by a method of JIS (Japanese Industrial Standards) K 2283.

(2) Density (15 Degrees C.):

Measured by a method of JIS K 2249.

(3) HTHS Viscosity (150 Degrees C.):

Measured by a method of ASTM D4683 using a TBS (Tapered Bearing Simulator) high temperature viscometer. Testing conditions are shown as follows.

Shear Rate: $10^6$ $sec^{-1}$

Revolving Speed (motor): 3000 rpm

Space (Rotor/Stator): 2 to 3 μm

Sample Content: 20 to 50 ml

Measurement Time: 4 to 6 hours for correction and 15 minutes for testing (4) Viscosity at 150 Degrees C.:

The kinematic viscosity at 150 degrees C., which was obtained by extrapolation from the kinematic viscosity at 40 degrees C. and the kinematic viscosity at 100 degrees C., was multiplied by the density at 150 degrees C., which was obtained by extrapolation from the density at 15 degrees C. and the density at 80 degrees C., resulting in the viscosity at low shear at 150 degrees C.

(5) Motoring Torque Measurement Value

The below-specified engine was filled with each of engine oils shown in Table 2 to conduct a motoring torque test, whereby torque at a predetermined revolving speed was measured. Testing conditions are shown as follows.

Engine Type: 2.2 L in-line four-cylinder DOHC 16 valve engine

Temperature: 80 degrees C.

Revolving Speed: 800 rpm (6) Improvement Rate of Torque

An average value of the motoring torque measurement values under the above measurement conditions was calculated. The average value was compared with that of commercially available engine oil (a reference oil) of 10W-30 in SAE viscosity classification (Comparative 1). A changing rate therebetween was calculated as a improvement rate of torque.

Examples 1 to 12 and Comparatives 1 to 9

With use of the following various base oils, polymer compounds and additives (specifically shown in Table 1), a lubricating oil composition for an internal combustion engine (sample oil) was prepared according to compositions of Tables 2, 3, 4 and 5.

The prepared sample oils were evaluated on respective properties in the above-mentioned method. Results are shown in Tables 2, 3, 4 and 5.

<Base Oil>

In Examples and Comparatives, the following base oils (a) to (h) in GII, GIII and GIV stipulated in API (American Petroleum Institute) were used as base oils. The mineral oil base oils in use were all paraffinic.

Base Oil (a): Mineral oil-based hydrocracking base oil (API classification GIII) 150N Kinematic Viscosity (100 degrees C.) of 6.20 $mm^2/s$; Viscosity Index of 130

Base Oil (b): Mineral oil-based hydrocracking base oil (API classification GII) 150N Kinematic Viscosity (100 degrees C.) of 5.35 $mm^2/s$; Viscosity Index of 105

Base Oil (c): Mineral oil-based hydrocracking base oil (API classification GII) 150N Kinematic Viscosity (100 degrees C.) of 10.89 $mm^2/s$; Viscosity Index of 107

Base Oil (d): Mineral oil-based hydrocracking base oil (API classification GII) 600N Kinematic Viscosity (100 degrees C.) of 12.19 $mm^2/s$; Viscosity Index of 105

Base Oil (e): Synthetic oil-based poly-α-olefin (API classification GIV)

Kinematic Viscosity (100 degrees C.) of 9.80 $mm^2/s$; Viscosity Index of 139

Base Oil (f): Mineral oil-based hydrocracking base oil (API classification GII) 70N Kinematic Viscosity (100 degrees C.) of 3.12 $mm^2/s$; Viscosity Index of 109

Base Oil (g): Mineral oil-based hydrocracking base oil (API classification GII) 100N Kinematic Viscosity (100 degrees C.) of 4.28 $mm^2/s$; Viscosity Index of 116

Base Oil (h): Mineral oil-based hydrocracking base oil (API classification GIII) 100N Kinematic Viscosity (100 degrees C.) of 4.41 $mm^2/s$; Viscosity Index of 127

<Polymer Compound>

In Examples and Comparatives, an olefin copolymer (OCP) or polymethacrylate (PMA) having a mass average molecular weight as follows was used as a polymer compound.

OCP (a): mass average molecular weight of 4,700 (LUCANT HC600 manufactured by Mitsui Chemicals, Inc.)

OCP (b): mass average molecular weight of 7,000 (LUCANT HC2000 manufactured by Mitsui Chemicals, Inc.)

PMA (a): mass average molecular weight of 26,000 (ACLUBE A-1050 manufactured by Sanyo Chemical Industries, Ltd.)

PMA (b): mass average molecular weight of 45,000 (ACLUBE C-728 manufactured by Sanyo Chemical Industries, Ltd.)

PMA (c): mass average molecular weight of 100,000 (Paratone 8057 manufactured by Chevron Corporation)

PMA (d): mass average molecular weight of 230,000 (ACLUBE 740 manufactured by Sanyo Chemical Industries, Ltd.)

PMA (e): mass average molecular weight of 370,000 (ACLUBE 915 manufactured by Sanyo Chemical Industries, Ltd.)

PMA (f): mass average molecular weight of 420,000 (ACLUBE 702 manufactured by Sanyo Chemical Industries, Ltd.)

PMA (g): mass average molecular weight of 69,000 (PLEXOL-162 manufactured by Degussa GmbH)

<Friction Modifier>

Molybdenum-based Friction Modifier: molybdenum alkyldithiocarbamate was used as a molybdenum friction modifier. A content of molybdenum was 4.5 wt %.

Ashless Friction Modifier: glycerin monooleate was used as a fatty acid ester.

<Additives>

Additive Package: An additive package of a lubricating oil additive for a diesel engine (DH-1 additive) or a lubricating oil additive for a gasoline engine (SL additive) was used. Additives in the additive packages are shown in Table 1.

TABLE 1

| | | DH-1 additive | SL additive |
|---|---|---|---|
| Calcium metal detergent | (mass %) | 36.7 | 22.6 |
| ZnDTP | (mass %) | 9.2 | 11.3 |
| Alkenyl succinimide | (mass %) | 3.7 | 8.5 |
| Rust inhibitor | (mass %) | 18.3 | 18.9 |
| Antioxidant | (mass %) | 18.3 | 18.9 |
| Diluent oil and others | (mass %) | 13.8 | 19.8 |

TABLE 2

| | | | | Example 1 | Example 2 | Example 3 | Example 4 | Example 5 | Example 6 | Example 7 |
|---|---|---|---|---|---|---|---|---|---|---|
| Composition | Base Oil (mass %) | Base Oil (a) | | 86.8 | 87.3 | 87.8 | 87.8 | 52.4 | 58.8 | 65.0 |
| | | Base Oil (b) | | — | — | — | — | 34.7 | — | — |
| | | Base Oil (c) | | — | — | — | — | — | — | — |
| | | Base Oil (d) | | — | — | — | — | — | — | 23.8 |
| | | Base Oil (e) | | — | — | — | — | — | 30.0 | — |
| | Polymer Compound (mass %) | OCP (a) | | 2.0 | — | — | — | 2.0 | — | — |
| | | OCP (b) | | — | 1.5 | — | — | — | — | — |
| | | PMA (a) | | — | — | 1.5 | — | — | — | — |
| | | PMA (b) | | — | — | — | 1.5 | — | — | — |
| | | PMA (c) | | — | — | — | — | — | — | — |
| | | PMA (d) | | — | — | — | — | — | — | — |
| | | PMA (e) | | — | — | — | — | — | — | — |
| | | PMA (f) | | — | — | — | — | — | — | — |
| | | PMA (g) | | 0.3 | 0.3 | 0.3 | 0.3 | 0.3 | 0.3 | 0.3 |
| | Additive (mass %) | DH-1 | | 10.9 | 10.9 | 10.9 | 10.9 | 10.9 | 10.9 | 10.9 |
| Viscosity Index of Base Oil | | — | — | 130 | 130 | 130 | 130 | 121 | 135 | 125 |
| Evaluation Result (Sample Oil) | Kinematic Viscosity | 40° C. | $mm^2/s$ | 53.47 | 53.28 | 53.15 | 53.28 | 57.41 | 53.78 | 57.41 |
| | | 80° C. | | 14.01 | 14.01 | 13.98 | 14.04 | 14.11 | 13.95 | 14.39 |
| | | 100° C. | | 8.719 | 8.731 | 8.711 | 8.752 | 8.844 | 8.664 | 8.844 |
| | Viscosity Index | — | — | 140 | 141 | 141 | 142 | 131 | 138 | 131 |
| | Density | 15° C. | $g/cm^3$ | 0.859 | 0.859 | 0.860 | 0.860 | 0.864 | 0.857 | 0.864 |
| | HTHS Viscosity | 150° C. | mPa · s | 2.90 | 2.87 | 2.86 | 2.88 | 2.90 | 2.90 | 2.90 |
| | Viscosity | 150° C. | mPa · s | 2.90 | 2.87 | 2.89 | 2.92 | 2.90 | 2.90 | 2.90 |
| | Rate of Decrease in Viscosity | 150° C. | % | 1> | 1> | 1.0 | 1.4 | 1> | 1> | 1> |
| | Motoring Torque Measurement Value | 80° C. | kg · m | 3.53 | 3.53 | 3.53 | 3.53 | 3.53 | 3.53 | 3.54 |
| | Improvement Rate of Torque | — | % | 2.5 | 2.5 | 2.5 | 2.4 | 2.4 | 2.5 | 2.2 |

TABLE 3

| | | | | Comparative 1 | Comparative 2 | Comparative 3 | Comparative 4 | Comparative 5 | Comparative 6 | Comparative 7 |
|---|---|---|---|---|---|---|---|---|---|---|
| Composition | Base Oil (mass %) | Base Oil (a) | | — | — | 85.8 | 87.1 | 86.7 | 42.8 | — |
| | | Base Oil (b) | | 82.4 | 9.1 | — | — | — | 42.8 | 85.8 |
| | | Base Oil (c) | | — | 80.0 | — | — | — | — | — |
| | | Base Oil (d) | | — | — | — | — | — | — | — |
| | | Base Oil (e) | | — | — | — | — | — | — | — |
| | Polymer Compound (mass %) | OCP (a) | | — | — | — | — | — | 2.2 | — |
| | | OCP (b) | | — | — | — | — | — | — | 3.0 |
| | | PMA (a) | | — | — | — | — | — | — | — |
| | | PMA (b) | | — | — | — | — | — | — | — |
| | | PMA (c) | | 6.4 | — | 3.0 | — | — | — | — |
| | | PMA (d) | | — | — | — | — | — | — | — |
| | | PMA (e) | | — | — | — | 1.8 | — | — | — |
| | | PMA (f) | | — | — | — | — | 2.1 | — | — |
| | | PMA (g) | | 0.3 | — | 0.3 | 0.3 | 0.3 | 0.3 | 0.3 |
| | Additive (mass %) | DH-1 | | 10.9 | 10.9 | 10.9 | 10.9 | 10.9 | 10.9 | 10.9 |
| Viscosity Index of Base Oil | | — | — | 105 | 107 | 130 | 130 | 130 | 118 | 105 |
| Evaluation Result (Sample Oil) | Kinematic Viscosity | 40° C. | $mm^2/s$ | 71.07 | 97.34 | 55.55 | 52.55 | 51.58 | 61.66 | 60.72 |
| | | 80° C. | | 17.57 | 19.90 | 14.71 | 14.56 | 14.52 | 15.04 | 14.91 |
| | | 100° C. | | 10.71 | 11.49 | 9.172 | 9.198 | 9.214 | 9.165 | 9.104 |
| | Viscosity Index | — | — | 139 | 105 | 146 | 158 | 162 | 127 | 128 |
| | Density | 15° C. | $g/cm^3$ | 0.886 | 0.882 | 0.859 | 0.860 | 0.860 | 0.867 | 0.877 |
| | HTHS Viscosity | 150° C. | mPa · s | 3.10 | 3.40 | 2.90 | 2.94 | 2.92 | 2.92 | 3.10 |

TABLE 3-continued

| | | | | Comparative 1 | Comparative 2 | Comparative 3 | Comparative 4 | Comparative 5 | Comparative 6 | Comparative 7 |
|---|---|---|---|---|---|---|---|---|---|---|
| | Viscosity | 150° C. | mPa · s | 3.50 | 3.40 | 3.02 | 3.08 | 3.11 | 2.92 | 3.10 |
| | Rate of Decrease in Viscosity | 150° C. | % | 11.4 | 1> | 4.0 | 4.5 | 6.1 | 1> | 1> |
| | Motoring Torque Measurement Value | 80° C. | kg · m | 3.62 | 3.68 | 3.55 | 3.54 | 3.54 | 3.56 | 3.55 |
| | Improvement Rate of Torque | — | % | 0.0 | −1.6 | 2.0 | 2.1 | 2.1 | 1.8 | 1.8 |

TABLE 4

| | | | | Example 8 | Example 9 | Comparative 8 | Comparative 9 |
|---|---|---|---|---|---|---|---|
| Composition | Base Oil (mass %) | Base Oil (a) | | 87.7 | — | — | — |
| | | Base Oil (b) | | — | — | 78.7 | — |
| | | Base Oil (f) | | — | 6.0 | — | 6.0 |
| | | Base Oil (g) | | — | — | 5.0 | — |
| | | Base Oil (h) | | — | 77.1 | — | 79.4 |
| | Polymer Compound (mass %) | OCP (a) | | 2.0 | — | — | — |
| | | OCP (b) | | — | 3.0 | — | — |
| | | PMA (c) | | — | — | 6.0 | — |
| | | PMA (d) | | — | — | — | 4.0 |
| | | PMA (g) | | 0.3 | 0.3 | 0.3 | — |
| | Additive (mass %) | SL | | 10.0 | 10.6 | 10.0 | 10.6 |
| Viscosity Index of Base Oil | | — | — | 130 | 126 | 106 | 126 |
| Evaluation Result (Sample Oil) | Kinematic Viscosity | 40° C. | $mm^2/s$ | 54.14 | 38.83 | 68.41 | 37.02 |
| | | 80° C. | | 14.25 | 11.52 | 17.14 | 12.37 |
| | | 100° C. | | 8.876 | 7.453 | 10.49 | 8.274 |
| | Viscosity Index | — | — | 143 | 162 | 140 | 209 |
| | Density | 15° C. | $g/cm^3$ | 0.855 | 0.845 | 0.863 | 0.851 |
| | HTHS Viscosity | 150° C. | mPa · s | 2.90 | 2.60 | 3.14 | 2.62 |
| | Viscosity | 150° C. | mPa · s | 2.90 | 2.60 | 3.34 | 2.83 |
| | Rate of Decrease in Viscosity | 150° C. | % | 1> | 1> | 5.8 | 9.0 |

TABLE 5

| | | | | Example 10 | Example 11 | Example 12 |
|---|---|---|---|---|---|---|
| Composition | Base Oil (mass %) | Base Oil (a) | | 86.1 | 86.3 | 85.6 |
| | | Base Oil (b) | | — | — | — |
| | | Base Oil (f) | | — | — | — |
| | | Base Oil (g) | | — | — | — |
| | | Base Oil (h) | | — | — | — |
| | Polymer Compound (mass %) | OCP (a) | | 2.0 | 2.0 | 2.0 |
| | | OCP (b) | | — | — | — |
| | | PMA (c) | | — | — | — |
| | | PMA (d) | | — | — | — |
| | | PMA (g) | | 0.3 | 0.3 | 0.3 |
| | Additive (mass %) | DH-1 | | 10.9 | 10.9 | 10.9 |
| | | SL | | — | — | — |
| | | Molybdenum dialkyldithiocarbamate | | 0.7 | — | 0.7 |
| | | Glycerin monoleate | | — | 0.5 | 0.5 |
| Viscosity Index of Base Oil | | — | — | 130 | 130 | 130 |
| Evaluation Result (Sample Oil) | Kinematic Viscosity | 40° C. | $mm^2/s$ | 52.03 | 52.27 | 52.11 |
| | | 80° C. | | 13.77 | 13.78 | 13.77 |
| | | 100° C. | | 8.597 | 8.598 | 8.591 |
| | Viscosity Index | — | — | 142 | 141 | 141 |
| | Density | 15° C. | $g/cm^3$ | 0.860 | 0.859 | 0.859 |
| | Mo Content | — | wt % | 0.08 | — | 0.08 |
| | HTHS Viscosity | 150° C. | mPa · s | 2.90 | 2.90 | 2.90 |
| | Viscosity | 150° C. | mPa · s | 2.90 | 2.90 | 2.90 |
| | Rate of Decrease in Viscosity | 150° C. | % | 1> | 1> | 1> |
| | Motoring Torque Measurement Value | 80° C. | kg · m | 3.41 | 3.51 | 3.39 |
| | Improvement Rate of Torque | — | % | 5.8 | 3.0 | 6.3 |

[Evaluation Results]

As is understood from the results of Tables 2 to 5, the lubricating oil compositions according to the invention (Examples 1 to 12) each contain: a base oil having a viscosity index of 120 or more; and a polymer compound that includes a first constituent having a mass average molecular weight of less than 100,000 and a second constituent having a mass average molecular weight of 100,000 or more, the first constituent of 0.01 mass % to 10 mass % being contained relative to a total amount of the lubricating oil composition, the second constituent of less than 0.5 mass % being contained relative to the total amount of the lubricating oil composition, the lubricating oil composition exhibiting a viscosity index of 130 or more. Accordingly, the kinematic viscosity in the practical temperature range (80 degrees C. to 100 degree C.) can be set low while the viscosity at high-temperature high-shear is maintained high, thereby providing an excellent saving-fuel performance.

On the other hand, the lubricating oil compositions for the internal combustion engine in Comparatives 1 to 9 can not meet both properties that the kinematic viscosity in the practical temperature range is low while the viscosity at high-temperature high-shear is maintained high. For instance, in Comparative 2, the kinematic viscosity at 100 degrees C. is high although rate of decrease in viscosity is low.

Moreover, as for an improvement rate of torque, Examples 1 to 7 and 10 to 12 are superior to Comparatives 1 to 7. In particular, the improvement rate of torque is excellent in Example 11 added with an ashless friction modifier, more excellent in Example 10 added with a molybdenum-based friction modifier, further excellent in Example 12 in combination of an ashless friction modifier and a molybdenum-based friction modifier.

The invention claimed is:

1. A lubricating oil composition, comprising:

a base oil having a viscosity index of 120 or more; and a first polymer having a mass average molecular weight of less than 100,000 in an amount of 0.01 mass % to 10 mass % relative to a total amount of the lubricating oil composition, and a second polymer compound having a mass average molecular weight of 100,000 or more in an amount of less than 0.5 mass % relative to the total amount of the lubricating oil composition, wherein a viscosity index of the lubricating oil composition is 130 or more, and wherein the first polymer compound comprises (a) at least one of olefin copolymer of a mass average molecular weight of 4,700 or more and 7,000 or less and polymethacrylate of a mass average molecular weight of 26,000 or more and 45,000 or less, and (b) polymethacrylate of a mass average molecular weight of 69,000 or more and less than 100,000.

2. The lubricating oil composition according to claim 1, wherein the base oil is at least one of a mineral oil and a synthetic oil.

3. The lubricating oil composition according to claim 1, further comprising at least one of a molybdenum-based friction modifier and an ashless friction modifier.

4. The lubricating oil composition according to claim 1, wherein the first polymer compound is present in the amount of 0.1 mass % to 10 mass % relative to a total amount of the lubricating oil composition.

5. The lubricating oil composition according to claim 1, wherein the base oil is a mineral oil.

6. The lubricating oil composition according to claim 1, wherein the base oil is a synthetic oil.

7. The lubricating oil composition according to claim 1, wherein the first polymer compound is polymethacrylate.

8. The lubricating oil composition according to claim 1, wherein the first polymer compound is an olefin copolymer.

9. The lubricating oil composition according to claim 1, wherein the first polymer compound is a styrene copolymer.

10. The lubricating oil composition according to claim 1, wherein the first polymer compound is polyisobutylene.

* * * * *